US005578089A

United States Patent [19]

Elsamaloty

[11] Patent Number: 5,578,089

[45] Date of Patent: Nov. 26, 1996

[54] CLEAR CANDLE

[75] Inventor: Mohamed Elsamaloty, Wilmington, Ohio

[73] Assignee: Lancaster Colony Corporation, Columbus, Ohio

[21] Appl. No.: 522,837

[22] Filed: Sep. 1, 1995

Related U.S. Application Data

[63] Continuation-in-part of Ser. No. 429,606, Apr. 27, 1995, abandoned.

[51] Int. Cl.[6] ..... C11C 5/00

[52] U.S. Cl. ..... 44/275; 44/265; 431/288; 431/289; 431/291

[58] Field of Search ..... 44/275, 265, 459; 431/288, 289, 291

[56] References Cited

U.S. PATENT DOCUMENTS

| | | | |
|---|---|---|---|
| 3,107,511 | 10/1963 | Hamsag-Garshanin et al. | 431/288 |
| 3,411,855 | 11/1968 | Olund | 431/288 |
| 3,615,284 | 10/1971 | Caesar | 44/275 |
| 3,615,289 | 10/1971 | Felton | 44/275 |
| 3,630,695 | 12/1971 | Duling | 44/275 |
| 3,645,705 | 2/1972 | Miller et al. | 44/275 |
| 3,741,711 | 6/1973 | Bryant | 431/125 |
| 3,771,445 | 11/1973 | Campbell et al. | 44/275 |
| 3,819,342 | 6/1974 | Gunderman et al. | 44/275 |
| 3,844,706 | 10/1974 | Tsaras | 431/288 |
| 3,857,805 | 12/1974 | Prickril . | |
| 3,926,655 | 12/1975 | Miles | 106/243 |
| 4,051,159 | 9/1977 | Tsoucalas et al. | 428/474.7 |
| 4,096,299 | 6/1978 | Stewart | 427/264 |
| 4,332,548 | 6/1982 | Linton et al. | 431/280 |
| 4,449,987 | 5/1984 | Lindauer | 44/275 |
| 4,855,098 | 8/1989 | Taylor | 44/275 |
| 5,132,355 | 7/1992 | Nahlovsky . | |
| 5,221,534 | 6/1993 | DesLauriers et al. . | |
| 5,387,418 | 2/1995 | Marin et al. | 424/409 |

FOREIGN PATENT DOCUMENTS

| | | |
|---|---|---|
| 0224389 | 6/1987 | European Pat. Off. . |
| 8800603 | 1/1988 | WIPO . |

OTHER PUBLICATIONS

Kajiura Hiroichi, Novel Synthetic Wax, May 17, 1986, Publication No. JP61098780, pp. 01/01 and 647–655.

*Primary Examiner*—Prince Willis, Jr.
*Assistant Examiner*—Cephia D. Toomer
*Attorney, Agent, or Firm*—Dinsmore & Shohl, P.L.L.

[57] ABSTRACT

A clear candle made from a gel comprising mineral oil containing blends of diblock and triblock copolymers based on synthetic thermal plastic rubbers. The clear candle is stable, does not separate, and does not flash when burned. The candle, although free standing at room temperature, will preferably be supplied in a container, and it may be colored and/or scented.

20 Claims, No Drawings

CLEAR CANDLE

This is a continuation-in-part application of application Ser. No. 08/429,606 filed Apr. 27, 1995, now abandoned.

FIELD OF THE INVENTION

This invention relates generally to candles and more specifically to clear candles comprising a gel. The clear candle body of this invention comprises a heterophase thermally reversible mineral oil gel formed by a system of physically crosslinked block copolymers. The gel consistency may be controlled by varying the amount, ratio and types of certain copolymers, including diblock and triblock copolymers, so as to provide a gel which has desirable properties for a stable, safe, and attractive clear candle.

BACKGROUND OF THE INVENTION

While the burning of a candle might appear to be simple and uninvolved, in fact, the process that takes place in the burning of a candle imposes rather stringent requirements upon the candle body material. At the outset, a typical wax candle body must be rigid enough to support itself (or be supported), in a relatively long wick filament, but it should not be excessively brittle at low room temperatures.

With respect to the actual burning of the candle, the heat of the candle's flame melts a small pool of the candle body material around the base of the exposed portion of the wick, and this molten material is then drawn up through and along the wick by capillary attraction, to fuel the flame. A candle's melting point is critical, in that the candle material should liquefy at or below temperatures to which the candle's material can be raised by radiant heat from the candle flame. If the candle's melting temperature is too low, the candle will drip or, in an extreme case, the entire candle body will melt, dropping the wick into a pool of molten body material, with the potential that the surface of the pool could ignite. If too high a temperature is required to melt the body material, the flame will be starved because insufficient fuel will be drawn up through the wick, with the result that the flame will be too small to maintain itself. Moreover, when molten, the candle body material must have a relatively low viscosity to insure that it will be capable of being drawn up through the wick by capillary action. In addition to meeting the above requirements, it is preferred that the candle body material burn with a flame that is both luminous and smokeless, and the odors that are produced by its combustion should not be unpleasant or intrusive.

Heretofore no composition that meets all these requirements has been transparent or clear (the terms "clear" and "transparent" are used interchangeably herein and connote a substantial absence of cloudiness/obscurity, so that the product features an ability to let light pass through in a substantially unobstructed manner, and an ability to have colorant added to the composition without the loss of the absence of cloudiness/obscurity or of the ability to let light pass through in a fairly unobstructed manner). Although clear candles have been disclosed in the prior art, none of these formulations have fulfilled all of the above described requirements of a candle in general, nor have they possessed all of the benefits of the clear candle of this invention. The present invention has an objective of providing a clear candle with a soft rubbery consistency which does not change or harden, and which possesses all of the necessary characteristics of a candle and which, moreover, is truly transparent.

The candle body of this invention is made by the physical cross linking of copolymers to form a gel which is heterophase ("heterophase" as used herein means a 2-phase system, which comprises an "oil" phase and a "block co-polymer" phase, the two phases being separate chemically and on a micro scale physically, but indistinct on a macro scale physically), and thermally reversible (i.e., when the gel is heated, the chemical composition of the gel remains the same, only physical properties of the gel—such as viscosity—change). The clear candles disclosed in the prior art are typically manufactured with a thermoplastic polyamide resin which requires a chemical reaction to solidify the gel. The polyamide resin materials of these prior candles, when heated, melt into and form chemical substances different from the original monomers or chemical constituents. Thus, these polyamide resin based clear candles are not thermally reversible.

A characteristic polyamide resin based candle is disclosed in U.S. Pat. No. 3,819,342 ("the '342 patent"). This patent discloses a transparent candle composition comprising a thermal plastic polyamide resin and a flammable solvent described as being capable of solubilizing the resin at a temperature below about 212° F., and forming a transparent gel-type structure. The solvent of the '342 patent is selected from the group consisting of unsaturated fatty acids, unsaturated fatty alcohols, saturated fatty alcohols, esters of fatty acids with polyhydric alcohols and glycerol, and mixtures thereof, and being present in amounts sufficient to gel the resin. Additional materials used in this candle are coloring, anti-flaring compounds, perfumes, clarifying agents. Examples of different anti-flaring compounds are listed, however, the requirement of an anti-flaring compound points out a most serious problem with all polyamide resin based candles. Specifically, polyamide resins are known to separate into layers, and, after separation, the top of the candle is covered with an oil layer that flashes when lit. This flashing can obviously be hazardous and is functionally inconsistent with a candle's natural function of providing reliable, consistent lighting. Clear candles made in accordance with this invention have the advantage of being completely stable over time. They will not separate into layers as prior art candles would, and thus there is no excess fluid available to flash.

U.S. Pat. No. 3,615,289 ("the '289 patent"), discloses another clear candle that is chemically very similar to the devices of the '342 patent discussed above. The '289 patent discloses a candle composition which may be transparent or pastel shaded and which is allegedly adapted to incorporate perfumes without flashing during burning. The basic composition of the '289 patent comprises a thermoplastic polyamide resin formed from linoleic acid polymerized with polyamide compound; an alkolamide or alkanol; and a stearic acid compound. The '289 patent further describes the use of polyamide resins to allegedly help eliminate "sweating" and to provide a smoother and glossier finish. Sweating is the process whereby oils migrate out of the candle body to the surface, giving it a oily texture, and is most commonly caused by syneresis. Syneresis occurs when oil is physically squeezed out from the candle body because of excessive chemical crosslinking. Sweating is not only an aesthetic drawback, it can be a performance or safety problem as well. If a candle sweats, the oil on the surface is available to ignite, which can result in an uncontrolled or torch-like situation rather than a candle.

Practical experience with, and laboratory testing of, the '289 and '342 candles has indicated that separation was a consistent and serious problem. Sweating also occurred in these candles, but the amount of oil secreted was small with respect to the large pool of oil that forms on the top of the candles after phase separation. The gel based candle of the present invention does not sweat or separate, because syneresis can be easily controlled by adjusting the ratio of diblock to triblock polymers to insure that all of the oil is entrained within a system of physically crosslinked copolymers.

The '289 patent also discusses the optional addition of ionic surface agents to prevent "blooming" or fogging of the candle which would result in the loss of transparency. This is significant because another persistent complaint about commercially available polyamide resin based candles is that they are initially cloudy or they become cloudy over time. The addition of the ionic surface agents may help this problem in some cases, but it does not eliminate cloudiness in the polyamide resin based candles. In stark contrast, candle's made according to this invention start out clear, remain clear during burning, and do not "bloom" or fog over time.

U.S. Pat. No. 3,645,705 discloses a transparent candle body material formed by combining a straight chain aliphatic amide with white mineral oil and alcohol. The '705 material is therefore, polyamide resin based, and is described as providing a molded, solid, and free standing product. The resin is mixed with natural oils to cause it to gel. This invention claims to be transparent as glass but slightly yellow due to the oil content. There is also a methyl ester added for hardness. The '705 patent is, however, similar in composition to the '342 and '289 patents and has the same structural and functional problems associated with it, and is therefore chemically as well as physically distinct from the present invention.

U.S. Pat. No. 3,741,711 ("the '711 patent"), discloses a clear, undyed and unpigmented wax based "candle." However, a closer reading of this patent indicates that the invention is a reusable "candle holder" and not a "candle". Particularly, the '711 patent discloses a multilayer holder with a decorated outer surface. The disclosure further states that the candle body has "an illuminous glow throughout the body of the candle . . . when the candle is being burned." There are, however, no compositions claimed, or disclosed, other than wax. In this particular patent, "clear" apparently means, a wax that is undyed and unpigmented. The lack of pigment and/or dye is referred to numerous times in the disclosure, but there is no disclosure that the wax used is any different than the opaque paraffin wax used in normal candle making. In contrast, the clear candle of the present invention is a true candle that burns and is consumed, and it is not a wax based candle but rather a gel based system of physically crosslinked copolymers.

Thus, in general, the clear candle of this application addresses and overcomes the structural, aesthetic and functional problems of prior art candles by providing a gel body of the present invention is formed by physically crosslinked block copolymers in a heterophase thermally reversible mineral oil gel. The paraffin wax or polyamide thermoplastic resin products known heretofore cannot provide a stable, clear candle having the structural and performance advantages as set forth herein.

PCT Application No. WO 88-00603 ("the '603 publication"), published Jan. 28, 1988, describes block copolymers which can be advantageously used as one or more components in the present invention. These block copolymers are described as gels or gelloid liquid extended polymer compositions which can comprise an intimate mixture of a block copolymer containing relatively hard blocks and relatively elastomeric blocks. The additional polymer or copolymer material of this disclosure is to have at least partial compatibility with and a higher glass transition softening or melting temperature than the hard blocks of the block copolymer, and at least 500 parts by weight of extender liquid per 100 parts of the block copolymer, the liquid being present to extend and soften the elastomeric blocks of the block copolymer. The extender liquid can be a hydrocarbon oil and/or a synthetic oil and the resulting gels or gelloid compositions are of the type which can be used in the clear candle of the present invention. However, there is no teaching, or suggestion in the '603 publication of the potential for using these materials in a candle, let alone to form a clear candle. The '603 publication is hereby incorporated by reference herein.

Similarly, gel material as described in U.S. Pat. No. 5,221,534 ("the '534 patent") can also be utilized as the gel material for the body of the candle of the present invention. The '534 patent describes a health and beauty aid gel composition comprised of one or more health and beauty aid components, a mineral oil, and a blend of at least two different polymer members. The viscous, yet flowable material of the '534 patent was initially contemplated by the present applicant as a potential additive for standard wax based candles to enhance quality and to make them softer and less brittle, because the material of the '534 patent does not coke during burning. As a candle burns down into a container there may be insufficient oxygen at the bottom of the container to support complete combustion. Particles of incomplete combustion (known as soot or coke) can thereby form on the upper inside edge of the container; coking typically takes the form of a black smudge-like ring around the top of the container. During testing, however, it was observed that the material of the '534 patent began to separate into layers when it sat for a short period of time. Also, the material flashed when the wick placed in it was lit. These characteristics made this material unsuitable for the purpose of a candle additive.

During testing however, a reformulated, more gel-like version of the material of the '534 patent was checked for possible use as an additive. The amount of the triblock polymers was increased so as to make the material more gel-like. While the product was determined to be of no interest as a candle additive, the testing led to an important discovery. The reformulated material was heated until it flowed, it was poured into a jar. A wick was then placed into it, and the sample was burned. There was no separation into phases, no sweating, and the material did not flash when burned. Surprisingly and quite unexpectedly, it was discovered that the experimental candle was transparent, it's body glowed when lit, and it did not discolor upon burning. The transparent nature of the candle made it extremely attractive.

Although this reformulated version of the '534 patent forms an excellent clear candle, it is at the same time rendered less suitable for its original purpose as a carrier for health and beauty aid compositions because of its gel (semi-solid) form. Importantly, there is no teaching or suggestion in the '534 patent of the potential for using this material as a candle. The disclosure of the '534 patent is hereby incorporated herein by reference.

SUMMARY OF THE INVENTION

While not exclusive, the following describes some of the important features and objectives of the present invention.

One object of the present invention is to form a non-coking candle which burns cleaner than both wax and polyamide resin based candles. Although it is possible for the gel candle of the present invention to be starved for oxygen, the gel candle burns slower than wax and the oxygen demands are less, thus the potential for coking is obviated.

It is yet another object of the present invention to form a candle which has a slower burn rate than a normal paraffin wax candle or a polyamide resin based candle. Wax based and polyamide resin based candles burn more than 2 times faster than the gel material of this invention. In other words, the time to consume the entire clear gel candle takes more than twice as long as a standard paraffin wax, based on the same size and shape, candles.

Thus, it is a further object of the present invention to form a candle which is longer lasting than wax based and polyamide resin based candles.

Another object of the present invention is to mold a candle, which when colored, does not fade, is more stable and longer lasting than both wax and polyamide resin based candles. Wax based and polyamide resin based candles are typically dyed with organic dyes which are sensitive to light. Pigments are not used in molded candles because they effect the burn of a wax based candle and they decrease the clarity of a polyamide resin based candle. When a colored wax based or polyamide based candle sits on a table, or in any form of light, it's color begins to fade over time. The dye fades due to a chemical reaction of the organic dye with the organic candle body material in the presence of light and oxygen. The gel material of this invention does not chemically react with dyes and therefore, the color fades significantly less over time.

A further object of the present invention is to form a candle which has a lower tendency to become brittle with age, as compared to wax based candles and polyamide resin based candles. Polyamide resin based candles become brittle as the oil component separates, or "sweats" out of the candle body. The gel candle body of this invention addresses this problem, as the gel is stable over time because the oil component is permanently entrained in the system of crosslinked copolymers. Furthermore, there are no chemical reactions occurring between components within the gel candle body so there is no gradual deterioration as is common with wax.

Yet another object of the present invention is to form a candle which is thermally reversible. This thermal reversibility gives the clear candle of the instant invention significant process advantages over polyamide resin based candles. The polyamide resin based candles are solidified via a chemical polymerization reaction. This reaction cannot be reversed and all mixing, pouring and molding must be done at one time. Any mistakes in the molding process and a polyamide candle is mined. The thermally reversibility of the clear candle of the present invention allows the easy mixing of color(s) and/or fragrance(s). Furthermore, the clear candle of the present invention may be poured into containers in one step or a series of steps. The manufacturer has great latitude in processing because after the gel is cooled it can be reheated to a fluid state, reworked, and recooled any number of times. Thermal reversibility allows the manufacturer to recycle material. For instance, if one candle container sells better than another, premade candles can be heated, removed from their old containers and poured into a more popular container. This recycling is not possible with a polyamide resin based candle.

It is also an object of the present invention to form a candle which does not exhibit syneresis. Syneresis, the secretion of oil from a gel due to excessive crosslinking, is a serious problem with the polyamide resin based candles as discussed above. The polyamide based candles are chemically crosslinked to such a great extent that oil is exuded therefrom and oil layers can form. The presence of an oil layer on a candle is a serious safety concern. The gel candle body of the present invention is not prone to syneresis. Because physical, as opposed to chemical, crosslinking is involved the ratio, amount, and type of copolymers can be controlled to eliminate syneresis. The copolymers form three-dimensional networks or gels through physical crosslinks. Crosslinking in these block copolymers occurs due to the formation of submicroscopic particles of a particular block, referred to as domains. Crosslinking of the insoluble domains can be obtained by factors affecting the crosslink density of the networks including length of insoluble block domains, length of soluble block domains, and the number of crosslinkable sites. For example, branched or star polymers will have more crosslinks than triblock or diblock polymers. The type of solvent or plasticizer to which the blocks are subjected will also affect these characteristics.

The above objects are achieved in accordance with the first aspect of the present invention which is a candle comprising: at least one wick; a container; a clear body; said wick being disposed through said body near the central axis of said body, said body being disposed in said container; and wherein said body is a clear gel comprising about 80 to 99 wt. % of a hydrocarbon oil, and about 1 to 20 wt. % of a blend of at least two different polymer members selected from the group consisting of diblock copolymers, triblock copolymers, radial block copolymers and multiblock copolymers, said composition including at least one diblock copolymer and at least one triblock copolymer. Preferably, said at least one diblock copolymer and said at least one triblock copolymer comprise from about 1 to 99 wt. % of said blend of at least two different polymers, said diblock and triblock polymers comprising segments of styrene monomer units and rubber monomer units.

In accordance with another aspect of the present invention, there is disclosed a method of using a gel composition as a candle material, said gel composition comprising about 80 to 99 wt. % of a hydrocarbon oil, and about 1 to 20 wt. % of a blend of at least two different polymer members selected from the group consisting of diblock copolymers, triblock copolymers, radial block copolymers and multiblock copolymers, with the proviso that there be contained in the composition at least one diblock copolymer and at least one triblock copolymer. Preferably, said at least one diblock copolymer and said at least one triblock copolymer comprise from about 1 to 99 wt. % of said blend of at least two different polymers, said diblock and triblock polymers comprising segments of styrene monomer units and rubber monomer units.

DETAILED DESCRIPTION OF INVENTION

The preferred embodiments of the present invention will now be described in greater detail below.

The clear gel described herein has been found to be especially useful as a clear candle material, and preferably comprises a blend of polymers in combination with a hydrocarbon oil. The hydrocarbon oil can be a cosmetic grade hydrocarbon oil (natural or synthetic) and more preferably it is white oil. Such hydrocarbon oils should have characteristics which will cause them to remain liquid at temperatures ranging from 0° C. up to about 200° C. for almost all applications, and may be a paraffinic oil, a naphthenic oil, natural mineral oil or the like.

The blend of polymers preferably comprises at least two components selected from the group consisting of diblock copolymers, triblock copolymers, radial copolymers, multiblock polymers and mixtures thereof. It is required that at least one diblock and at least one triblock copolymer be present in the blend. Commercially available thermoplastic rubber type polymers which are especially useful in forming the compositions of the present invention are sold under the trademark Kraton® by Shell Chemical Company. The Kraton® rubber polymers are described as elastomers which have an unusual combination of high strength and low viscosity and a unique molecular structure of linear diblock, triblock and radial polymers. Each molecule of the Kraton® rubber is believed to consist of block segments of styrene monomer units and rubber monomer units and each block segment may consist of 100 monomer units or more. The most common structure is the linear ABA block type; styrene-butadiene-styrene (SBS) and styrene-isoprene-styrene (SIS), the Kraton® D rubber series. A second generation polymer of this series is the Kraton® G series which are styrene-ethylene-butylene-styrene type (S-EB-S) polymers. Diblock polymers include the ABA type and the SB, styrene-ethylenepropylene (S-EP) and (S-EB). The ABA structure of the Kraton® rubber molecule has polystyrene endblocks and elastomeric midblocks. This series of polymers is sold commercially and indicated as being major compounding ingredients or additives in adhesives, sealants and coatings, asphalt modification for roads and roofing, polymer modification, thermoset modification, and oil modification including use as viscosity index improvers, greases and gels. The Kraton® G rubbers are indicated as being compatible with paraffinic and naphthionic oils and the triblock copolymers are reported as taking up more than 20 times their weight in oil to make a product which can vary in consistency from a "Jello" to a strong elastic rubbery material depending on the grade and concentration of the rubber.

A preferred clear candle body composition of the instant invention is prepared by blending into the hydrocarbon oil the mixture or blend of diblock and triblock or other copolymers in the desired amounts. The amounts of each copolymer and the amount of the mixture contained in the hydrocarbon oil will determine the final form of the gel. Care must be taken to insure the ratio, amount and type of ingredients are correct to yield a clear semi-solid gel. The semi-solid gel is the candle "body."

The gel is formed by blending the polymers and oil and heating them to between about 50° to 90° C. to dissolve the polymer blend in the oil. Mixing may be carried out in any conventional manner. On cooling, the gel forms. Fragrance(s) and/or color(s) may be added at any time prior to cooling. Alternatively, a formed gel can be heated to reform the solution, upon which the fragrance(s) and/or color(s) may be added, and the gel allowed to reform on cooling.

The resulting gel is preferably free standing at room temperature (the candle "body") and must be heated to about 200° Fahrenheit (93.3° C.), plus or minus 10° before it flows easily. After the fragrance(s) and/or color(s) are mixed into the material it is poured into a container. Typical colors and fragrances which can be used in preferred embodiments are listed in tables 1 and 2.

TABLE 1

| Scent Supplier | Scent |
|---|---|
| Fragrance Resources | Lilac 91F/1733 |
| | Balsam Pine 91F/1733 |
| | Potpourri 92F/2285 |
| | Citrus Grove 94F/1517 |
| | Pure Peach 94F/1689 |
| | Melon Patch 94F/2103 |
| French Chemical | Mint 308 |
| | Hollyberry 349 |
| Libenn Aroma | Black Cherry 11843 |
| Manheimer | Pomegranite 801047 |
| | Blueberry 830315 |
| | Floral Sachet 801021 |
| Noville | Wildflower 26445 |
| | Sugar Plus 89835 |
| | Peppermint AN100049 |
| | Charlie 27950 |
| | Pina Colada AN100050 |
| | Magique Noire 28565 |
| | Vanilla AN107067 |

TABLE 2

| Dye Supplier | Color |
|---|---|
| Bekio | Blue 3104 |
| | Navy 3464/54 |
| | Biege-Rose 3963/37 |
| French | Fat Yellow |
| | Oil Scarlet Cake |
| | Lilac D-270 |
| | Oil Orange |
| | Cherry Red |
| | Navy D-366 |
| | Solvent Green |
| Goldmann | Green F2717 |
| | Yellow F2825 |
| | Blue F2828 |
| Thermocolor | 5GS Green Cake |

The container for a candle made hereunder can comprise any of a variety of devices which can contain the gel, do not bum, and do not melt. Preferably, a faceted glass container can be used for aesthetic purposes. While it is contemplated that a clear candle made according to the present invention could be provided without a container, due to the gel-like nature of the candle itself, and its potential flowability when heated, it is preferred that such candles include an appropriate container.

A wick is placed in the candle body before the gel firms up. The term "wick" as used herein means any filamentary body which is sufficiently sturdy, which will bum with a flame, and which is capable of drawing up the molten candle material by capillary action. Preferably, the wick can be any properly sized commercially available wick. For example, an appropriately sized Atkins and Pierce 60/40/18 type wick, saturated with a high molecular weight microcrystalline wax can be used. Also preferably, more than one wick may be used in a single candle according to the present invention.

The blend of copolymers used in the preferred formulation of the clear candle body is a mixture of diblock copolymers and triblock copolymers. Each polymer contains at least two incompatible segments, for example at least one hard and one soft segment. In general in the diblock polymer, segments will be sequential with respect to hard and soft segments. In a triblock polymer, the segment ratio is two hard/one soft, two hard/one soft, etc. (i.e. a 2-1-2-1 copolymer). The multiblock polymers can contain any combination of hard and soft segments. In the clear candle composition, however, there must always be present at least one diblock and one triblock copolymers, and the combination must also provide both the hard and soft characteristics necessary for the composition. These characteristics are necessary in order to provide the controlled syneresis which is an essential part of the present invention.

The body of the clear candle is thereby preferably provided in a gel form comprising about 80 to 99 wt. % of a hydrocarbon oil, and about 1 to 20 wt. % of a blend of at least two different polymer members selected from the group consisting of: diblock copolymers, triblock copolymers, radial block copolymers and multiblock copolymers, there being present at least one diblock copolymer and at least one triblock copolymer. While the precise ratio of diblock and triblock copolymers can be varied to provide varying characteristics to the gel, it has been found that both must be present. Preferably, said at least one diblock copolymer and at least one triblock copolymer comprise from about 1 to 99 wt. % of the blend of polymers. Even more preferably, the diblock copolymer forms from about 1 to 3 weight percent of the blend of polymers, while the triblock copolymer forms from about 97 to 99 weight percent of the blend of polymers. It has been found that having a disproportionately large part of the triblock in comparison to the diblock, tends to make the material more gel-like and less prone to crumbling. The diblock or triblock copolymers should also have copolymers comprising block segments of styrene monomer units and rubber monomer units.

The diameter of the gel candle body is preferably less than 3 inches (7.6 cm) as it has been observed that if the gel candle is larger, the heat of the wick may not melt the entire top of the candle surface. This will leave some gel material around the edges unburned and the candle will burn down the middle, leaving the edges of the container coated with some of the material. This is not preferred for aesthetic reasons, and due to the general wasteful nature of such performance.

Thus, it is apparent that there has been provided a clear candle, in accordance with the present invention, and responding to the aspects and objects as set forth above. While the invention has been described in conjunction with specific embodiments, it is evident that many alternatives, modifications and variations will be apparent to those skilled in the art in light of the foregoing description and examples, and without deviating from the contemplated scope of the present invention. Accordingly, it is intended to embrace all such alternatives, modifications and variations which fall within the spirit and scope of the appended claims.

I claim:

1. A candle comprising:

at least one wick;

a clear body;

said wick located in said body; and wherein said body is a clear gel comprising about 80 to 99 wt. % of a hydrocarbon oil, and about 1 to 20 wt. % of a blend of at least two different polymer members selected from the group consisting of diblock copolymers, triblock copolymers, radial block copolymers and multiblock copolymers, said composition including at least one diblock copolymer and at least one triblock copolymer, with said diblock and triblock polymers comprising segments of styrene monomer units and rubber monomer units.

2. A candle according to claim 1 wherein said blend of at least two different polymers comprises from about 1 to 99 wt. % of said at least one diblock copolymer or said at least one triblock copolymer.

3. A candle according to claim 2 wherein the diblock polymers and triblock copolymers are derived from thermoplastic rubbers.

4. A candle according to claim 3 wherein the diblock polymers and triblock polymers contain insoluble portions and soluble portions and are thermoplastic rubbers.

5. A candle according to claim 1 wherein a colorant is added to said clear body.

6. A candle according to claim 1 wherein a fragrance is added to said clear body.

7. A candle according to claim 1, further comprising a container.

8. The candle of claim 7, wherein said body is disposed in said container.

9. The candle of claim 1, wherein said wick is located adjacent a central axis of said body.

10. A candle comprising:

at least one wick;

a container;

a clear body;

said wick located in said body, said body being disposed in said container; and wherein said body is a clear gel comprising about 80 to 99 wt. % of a hydrocarbon oil, and about 1 to 20 wt. % of a blend of at least two different polymer members selected from the group consisting of diblock copolymers, triblock copolymers, radial block copolymers and multiblock copolymers, said composition including at least one diblock copolymer and at least one triblock copolymer, with said diblock and triblock polymers comprising segments of styrene monomer units and rubber monomer units.

11. A candle according to claim 10 wherein said blend of at least two different polymers comprises from about 1 to 99 wt. % of said at least one diblock copolymer or said at least one triblock copolymer.

12. A candle according to claim 10 wherein the diblock polymers and triblock copolymers are derived from thermoplastic rubbers.

13. A candle according to claim 11 wherein the diblock polymers and triblock polymers contain insoluble portions and soluble portions and are thermoplastic rubbers.

14. A candle according to claim 10 wherein a colorant is added to said clear body.

15. A candle according to claim 10 wherein a fragrance is added to said clear body.

16. The candle of claim 10, wherein said wick is located adjacent a central axis of said body.

17. A method of making a candle comprising the steps of:

providing a gel composition comprising:

about 80–99% by weight of a hydrocarbon oil;

about 1–20% by weight of a blend of at least two different polymer members selected from the group consisting of diblock copolymers, triblock copolymers, radial block copolymers, and multiblock copolymers, wherein said blend contains at least one diblock copolymer or at least one triblock copolymer;

mixing said hydrocarbon oil and said blend to form a gel composition; and forming said gel composition into a candle body.

18. A method according to claim 17, wherein said gel composition is clear.

19. A method according to claim 17, wherein said blend comprises from about 1 to 99% by weight of said at least one diblock copolymer and at least one triblock copolymer.

20. A method according to claim 17, wherein said at least one triblock copolymer is a copolymer comprising block segments of styrene monomer units and rubber monomer units.

* * * * *